US005509357A

United States Patent [19]

Lawther

[11] Patent Number: 5,509,357

[45] Date of Patent: Apr. 23, 1996

[54] DUAL OPERATING MODE WARHEAD

[75] Inventor: Robert J. Lawther, Brea, Calif.

[73] Assignee: Northrop Grumman Corporation, Los Angeles, Calif.

[21] Appl. No.: 399,114

[22] Filed: Mar. 3, 1995

[51] Int. Cl.[6] ..... F42B 1/02

[52] U.S. Cl. ..... 102/307; 102/309; 102/476

[58] Field of Search ..... 102/307, 476, 102/309

[56] References Cited

U.S. PATENT DOCUMENTS

| | | | |
|---|---|---|---|
| 3,648,610 | 3/1972 | van Zyl et al. | 102/4 |
| 3,664,262 | 5/1972 | Rose et al. | 102/56 |
| 3,726,223 | 4/1973 | Moe | 102/56 |
| 3,853,059 | 12/1974 | Moe | 102/67 |
| 4,058,063 | 11/1977 | Hurst | 102/56 SC |
| 4,145,972 | 3/1979 | Menz et al. | 102/270 |
| 4,160,412 | 7/1979 | Snyer et al. | 102/20 |
| 4,493,260 | 1/1985 | Foster | 102/307 |
| 4,499,830 | 2/1985 | Majerus et al. | 102/476 |
| 4,612,859 | 9/1986 | Furch et al. | 102/476 |
| 4,776,272 | 10/1988 | Lindstadt et al. | 102/307 |
| 5,370,055 | 12/1994 | Fugelso et al. | 102/308 |

*Primary Examiner*—Peter A. Nelson

*Attorney, Agent, or Firm*—Terry J. Anderson; Karl J. Hoch, Jr.

[57] ABSTRACT

A dual operating mode warhead comprises a generally cylindrical explosive charge having a longitudinal axis and an outer peripheral surface extending between front and rear facing initiation surfaces. A front detonator initiates peripheral detonation of the explosive charge at the front facing initiation surface and creates a detonation wave travelling through the explosive charge toward the rear facing initiation surface. A rear detonator initiates detonation of the explosive charge at the rear facing initiation surface and creates a detonation wave travelling through the explosive charge and toward the forward facing initiation surface. Against heavy armor, only the rear initiation is used. A precision shaped charge proximate the front facing surface is responsive to the rear detonation wave to produce a high speed forward travelling jet with excellent armor piercing capability. Against softer targets, a fragmentation case proximate the outer peripheral surface of the explosive charge is responsive to operation of both the first and second detonation waves to produce a radially directed planar sidespray pattern. With this construction, actuation of the rear detonator alone results in an armor piercing mode of operation whereas near simultaneous actuation of both detonators results in a wider area of impact of the forward focused energy and in an enhanced sidespray fragmentation. Timing of initiation of the two detonators will be optimized specifically for any design application.

3 Claims, 2 Drawing Sheets

FIG. 1
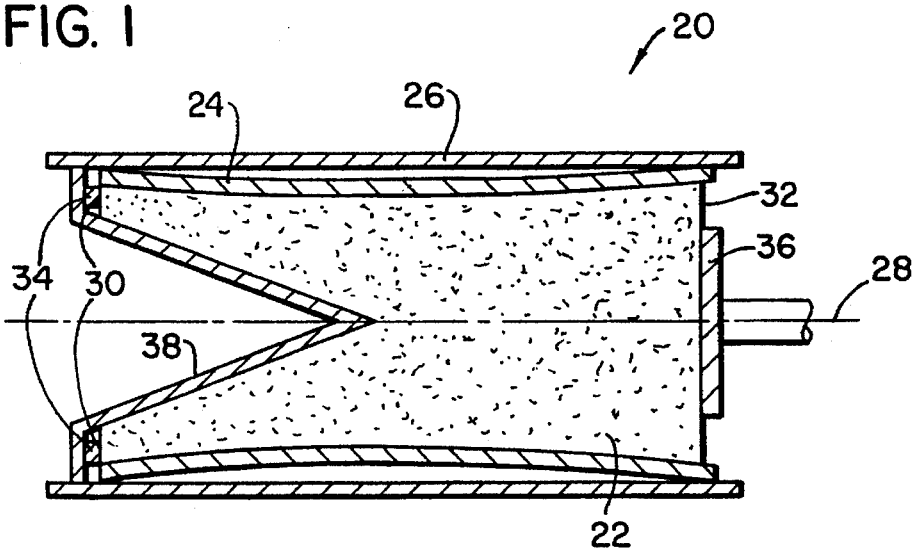
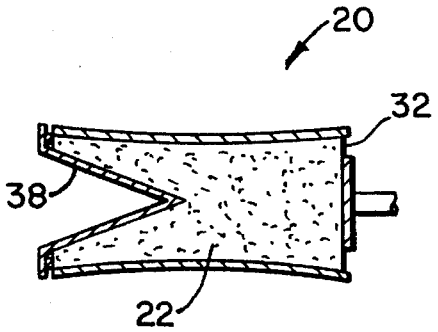
FIG. 2A
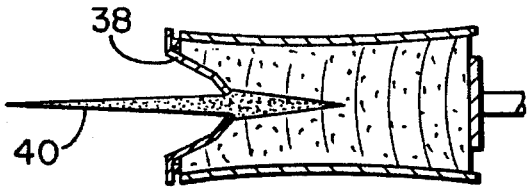
FIG. 2B
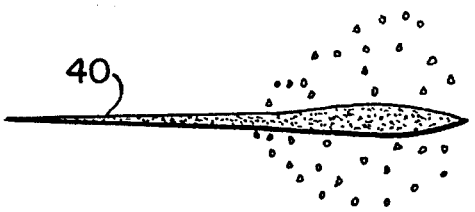
FIG. 2C

DUAL OPERATING MODE WARHEAD

BACKGROUND OF THE INVENTION

1. Field of the Invention

The present invention relates generally to warheads and, more particularly, to dual operating mode warheads which are selectively operable according to the type of target being engaged to assure maximum effectiveness against that target.

2. Description of the Prior Art

Modern warfare is becoming more and more intense, with weapons which are ever more lethal and which can be delivered in high fire rates with deadly accuracy. At the same time, mobility of force is receiving more emphasis. Logistics as well as effectiveness emphasize the benefits of multi-purpose munitions which can be ready for use with maximum effectiveness against a variety of targets. Working against this multi-target capability is the hardness of modern armor, which progressively requires more and more penetration capability to reach the vulnerable components, requiring warheads to be designed for maximum penetration against only one class of target. Sensors now permit the knowledge of the target class being attacked, sometimes before launch, and with the brilliant munitions currently under development, perhaps just before impact. It would be desirable to change the warhead function from one of achieving maximum penetration to one achieving maximum lethality with more moderate penetration when non-tank material targets such as armored personnel carriers or air defense or missile launchers are attacked.

It has long been a goal of armorers to provide in a single projectile the ability to successfully attack and destroy an enemy's heavy armor while simultaneously eliminating surrounding lightly armored positions and personnel. Selective examples of the prior art either directly or peripherally relating to this concept is provided below.

For example, in U.S. Pat. No. 3,648,610 to van Zyle et al. a minibomb warhead is disclosed in which simultaneous dual end initiation is said to produce an enhanced blast effect when the detonation wave converges in the central area of the minibomb where the missile fragments are wrapped.

U.S. Pat. No. 3,853,059 to Moe discloses a guided missile warhead with selectively operable multiple initiation devices intended to optimize the initial available explosive energy to effect the most efficient transfer of energy into high velocity fragments. A shift of the fragment beam spray along the length of the warhead can be obtained by selective initiation of either end of the warhead or simultaneous initiation at both ends.

U.S. Pat. No. 4,058,063 to Hurst discloses a warhead with an hourglass-shaped explosives charge. At either or both ends of the charge, an expandable rod structure or rod fragments are placed and arranged at any desired angle to the longitudinal axis of the charge. The charge is initiated intermediate its ends and, because of its shape, creates a concentrated pancake-configured, shock wave and gas cloud expanding radially outward from the center of the charge. It is said that because of the large amount of explosive between the initiation point and the rod structure, the rods are imparted with a higher velocity than in conventional warheads of comparable mass.

U.S. Pat. No. 4,145,972 to Menz et al. discloses a warhead initiation system provided with the selective capability of igniting the warhead from one end or from both ends simultaneously to control the fragmentation pattern, or fragment beam spray, of the warhead. The warhead can thereby be tailored for the target to optimize its effectiveness.

U.S. Pat. No. 4,612,859 to Furch et al. discloses a multiple purpose warhead for simultaneously combatting hard, semi-hard, and soft targets. For this purpose, it exhibits a plurality of different parts of equal diameter, including separate casings and explosive charges, each of which has a different type of cladding or layer and corresponds to a different target requirement, the different parts being arranged behind one another in succession.

U.S. Pat. No. 4,776,272 to Lindstadt et al. discloses a warhead with a charge adapted to selectively produce either a single compact projectile or, through suitable constructive measures, to be able to concurrently produce a plurality of projectiles, so as to be able to attack hard or heavily armored targets, such as a battle tank, as well as lightly armored or even unarmored targets by means of a projectile which is correlated with the target.

SUMMARY OF THE INVENTION

It was in light of the state of the technology as just discussed that the present invention was conceived and has now been reduced to practice. According to the invention, a dual operating mode warhead is provided which comprises a generally cylindrical or axially symmetric explosive charge having an outer peripheral surface extending between front and rear facing initiation surfaces. A front detonator initiates detonation of the explosive charge peripherally at the front facing initiation surface and creates a detonation wave travelling through the explosive charge toward the rear. A rear detonator initiates detonation of the explosive charge at the rear facing initiation surface and creates a detonation wave travelling forward through the explosive charge in the normal manner for shaped charges. Against heavy armor, only the rear initiation is used. A precision shaped charge proximate the front facing surface is responsive to the rear detonation wave to produce a high speed forward travelling jet with excellent armor piercing capability. Against softer targets, a fragmentation case proximate the outer peripheral surface of the explosive charge is responsive to operation of both the first and second detonation waves to produce a radially directed planar sidespray pattern. With this construction, actuation of the rear detonator alone results in an armor piercing mode of operation whereas near simultaneous actuation of both detonators results in a wider area of impact of the forward focused energy and an enhanced sidespray fragmentation pattern. Timing of initiation between the two ends shall be optimized for specific design applications.

The warhead concept of the invention exploits knowledge of the target being attacked to vary the warhead penetration capability and sidespray effects to achieve maximum lethality. The means of knowing the target type is immaterial to the invention, even though the evolution of brilliant munitions with such sensor inputs was the original stimulus to invent the adaptable warhead. Adaptable warheads are not in themselves new. Indeed, aimable warheads have been under investigation for over at least 30 years, and variable kill mechanisms have been proposed to vary the fragmentation pattern before detonation by manner of initiation or in other ways.

However, it is strongly believed that the specifics of the herein proposed approach are original and valuable. The invention is intended to incorporate a high efficiency stateof-the-art shaped charge design capable of many cone diameters penetration which is not degraded in attacking very hard targets, such as tanks. However, against lighter armor or light material targets, warheads with excellent penetration often merely enter the top or side and continue out the bottom or other side of the hardened target, rather than doing beyond-armor damage to the extent desired. If vulnerable components are not encountered along the path of travel of the warhead, the energy is largely wasted.

Thus, when attacking such non-tank targets, it is proposed by the invention to initiate the shaped charge at the apex or aft end (in accordance with conventional practice) and at the base as well (a new approach), with the designed end result that the shaped charge is not nearly so uniform, but rather is much more scattered, yet with all the penetration needed to defeat the lesser armor. Beyond-armor damage is increased much in the manner of explosive formed penetrators which spray much larger damage patterns than conventional high efficiency shaped charges.

Any time delay between the two initiations is intended to be very small and optimized as a function of the specific design application.

A further benefit of the invention is in the enhanced sidespray damage when attacking light targets, The effect is similar to that achieved, for example, with the AIM-9L "Sidewinder" type annular blast fragmentation warhead which is dual end initiated and launches titanium rods in a planar pattern to achieve what has been referred to as an energy density kill. Actually, the kill could be structural (especially on aircraft) or a vulnerable component kill. Light targets often have light material topside in the nature of missiles, rockets, antennae, launchers, fire control equipment of various sorts or guns which can be destroyed at the same time other vehicle components are destroyed behind the light armor. Multiple modes of kill are valuable in that a mission kill is more assured and the time to repair is increased or possibility of repair is eliminated.

Many options exist for the side spray design including discrete rods and fragmentation designs. A specific design would normally be highly influenced by the requirement to avoid degradation of the penetration against the very hard target, which leads toward uniform mass or small mass gradient in the case because irregularities disrupt shaped charge jet formation. Thus, the unique construction of the present invention resides in the integration of such dual end initiation with the adaptive shaped charge.

The present invention evolved from an assessment of warhead product improvement options to existing anti-armor munitions, there being particular interest associated with near miss kills or near hit kills, that is, strikes against other than the vulnerable components primarily of interest. The basic penetration capability of a warhead is sufficient to effect a kill when hitting the required target as planned. The effort leading to the present invention was intended to make the warhead and therefore the weapon more general purpose in its scope. Targets of interest would include mobile rocket launchers either multiple or single, communication vehicles, air defense vehicles, and the like. In addition, the achievement of additional component kills on an existing target set would,increase the time to repair or decrease the probability of repair, making the weapon more effective and, therefore, desirable.

Based on all of the above considerations, an approach evolved for the soft target mode which would provide annular blast fragmentation effects, focusing the energy in a plane perpendicular to the warhead axis. The approach to a representative warhead design is outlined below.

The design concept for the representative warhead incorporates the following features:

(1) Non-zero charge at the cone base since the last 10%, approximately, of the conventional liner does not contribute to penetration because of low velocity. A truncated design can be used with minimal penalty to achieve an increased blast charge without the penalty of reduced penetration. Design must be performed with a combination of hydrodynamic codes and verification tests. When initiated in the conventional manner, the anti-armor penetration performance is not to be influenced negatively.

(2) Essentially a cylindrical charge is to be employed rather than being sharply tapered at the rear of the warhead. This can be achieved without incurring a penetration performance penalty although the liner must be designed with the charge.

(3) Initiation mode 2 is dual end initiation, peripherally around the base of the cone, and nearly simultaneously at the aft end of the warhead.

(4) The detonation waves move toward each other, simultaneously beginning to project the warhead and munition case walls in a collapsing pattern. They meet in a very high reaction pressure area which has been referred to as a mach stem area. The blast wave is focused perpendicular to the warhead axis, adding to the mass and energy focus in that normal plane.

In the AIM-9L warhead evaluation, the damage criteria to assess and exhibit the effects! of the annular blast frag had to be defined, and was defined in terms of energy density on the target. The focus in the plane greatly increases the density of energy hitting the local area intersected.

In one instance, a capstan charge of this inventor's design, that is, a cylinder with concave-in walls to focus the blast energy, of 5 inch diameter and 8 inch length was fired, which sliced through ⅝ inch thick steel plate 2 feet from the charge.

When the shaped charge is initiated in the manner described herein, when attacking light targets, the energy projected forward and the momentum also are nearly the same as for normal initiation, but the alignment and velocity profile are all radically different, with the result that the effect is more that of a forward projected mass focus warhead than that of a precision shaped charge. The effects on the target would be expected to be somewhat akin to an explosively formed penetrator of low length-to-diameter ratio.

A near optimum anti-material fragmentation warhead having the weight of a conventional anti-armor warhead would provide a 10 to 20 foot lethal radius against a nominal thin skinned target. In this way, a hit on target would be within lethal radius of the vulnerable components. A goal for the representative design of the invention could be to focus at ten foot radius within an 8 inch ring with 80% of the side projected momentum.

The second goal is to suffer no degradation in RHA (rolled homogeneous armor, an industry standard) penetration relative to the baseline in the primary initiation mode.

In short, the present invention relates to a multi-mode warhead which packages in the same envelope as a conventional anti-armor warhead and compares with that warhead in armor penetration. It also has a sidespray mode which is initiated at both ends rather than only the apex end of the shaped charge. Fuze mode may be preselected by the pilot or commanded by an on-board processor based on sensor data.

When in the sidespray mode, the penetration is somewhat reduced, to resemble more an explosive formed penetrator action than a shaped charge. This provides an improved kill potential against light amor, although it would be reduced against heavy armor. In the dual initiation sidespray mode, the warhead all and missile skin are focused in an annular beam normal to the missile axis, achieving what is known as an energy density, or structural, kill of antennae, missile launchers, or other light structures In the near vicinity.

The penetration in the normal apex initiation mode is not reduced because the apparent truncation actually eliminates the portion of the jet which Was previously too slow to contribute to penetration, while increasing the jet mass at the penetrating velocities, thereby slightly delaying breakup of the jet and achieving longer effective lengths.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate one of the embodiments of the invention and, together with the description, serve to explain the principles of the invention in general terms. Like numbers refer to like parts throughout the disclosure

BRIEF DESCRIPTION OF THE DRAWINGS

FIG. 1 is a diagrammatic cross section view of a dual operating mode warhead embodying the invention;

FIGS. 2A, 2B, and 2C are diagrammatic side elevation views of the warhead of the invention illustrating successive stages of an explosion sustained by the warhead operating in a conventional armor piercing mode;

DETAILED DESCRIPTION OF THE PREFERRED EMBODIMENT

Figure 3A:
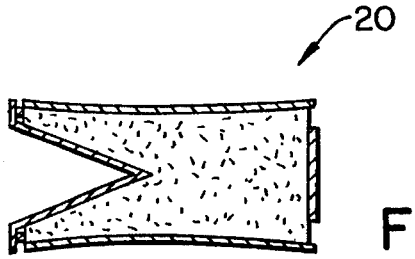
FIGS. 3A, 3B, 3C and 3D are diagrammatic side elevation views of the warhead of the invention illustrating successive stages of an explosion sustained by the warhead operating in a combined armor piercing and sidespray pattern mode.

Turn now to the drawings and, initially, to FIG. 1 which diagrammatically illustrates a dual operating mode warhead 20 embodying the present invention. The warhead 20 comprises a generally cylindrical explosive charge 22 encased within a warhead case 24 and a munition skin 26 having a longitudinal axis 28 and a front facing annular initiation surface 30 and a rear facing circular initiation surface 32. The front facing initiation surface 30 and the rear facing initiation surface 32 both lie in planes transverse of the longitudinal axis 28. The warhead case may serve as the munition skin in some designs.

A suitable detonator 34 is provided for initiating detonation of the explosive charge 22 at the front facing initiation surface 30 and creating a detonation wave travelling through the explosive charge toward the rear.

Another suitable detonator 36 is provided for initiating detonation of the explosive charge at the rear and creating a detonation wave travelling through the explosive charge toward the forward facing initiation surface.

The warhead also includes a shaped charge and liner 38. The surface 38 is illustrated as being approximately a right circular cone, having a rear facing apex 39 and the annular surface 30 at a base of the cone opposite the apex, although it may be hemispherical, tulip shaped or trumpet shaped. Explosive initiation may be accomplished by means of explosive foil or conventionally. To this end, the shaped charge typically includes the liner 38 of copper or more dense material.

Figure 3B:
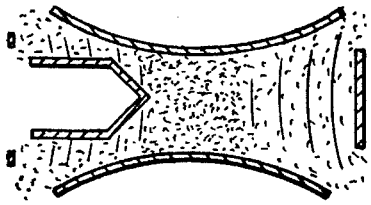
Figure 3C:
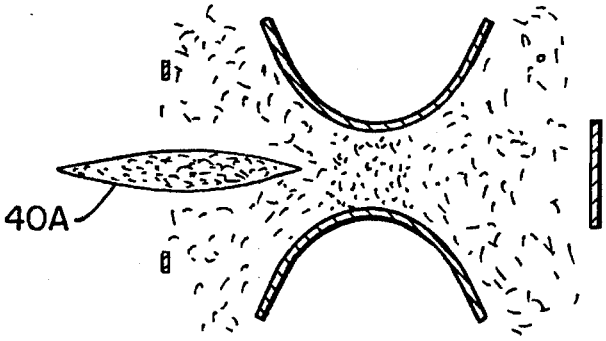
Figure 3D:
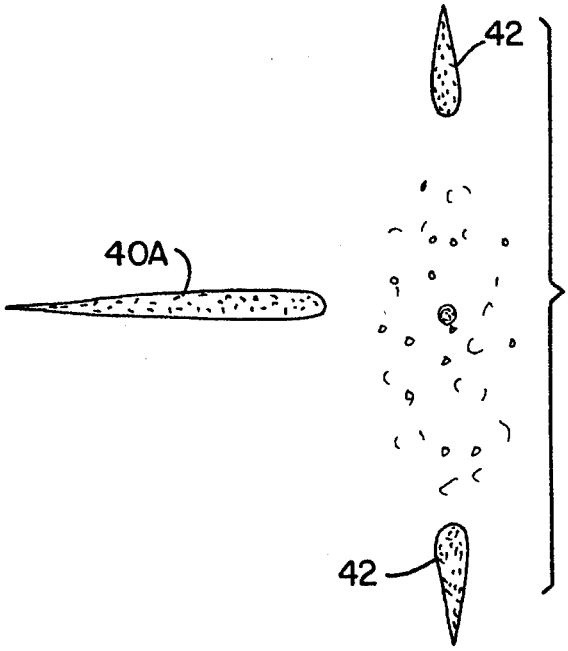

With continuing reference to FIG. 1, refer also now to FIGS. 2 and 3 which compare the dual functional modes of the warhead 20. FIGS. 2A, 2B, and 2C depict, in sequence, a typical shaped charge function shown without an outer skin, which is immaterial to the functional sequence. Here it is presumed that the warhead 20 is fired at a tank target, such that maximum penetration is desired to defeat the target. Rear initiation, that is, at the surface 32, is accomplished in a normal manner, which may be by explosive foil initiation, but in any event is precisely controlled to assure uniformity of explosive wave propagation.

FIG. 2B depicts the jet in partial collapse as the detonation wave has moved forward past the cone apex. FIG. 2C shows the liner fully collapsed and the extremely high pressure resulting in forward projection of the jet 40.

The shape of the explosive charge 22 should be optimized within the constraints of the design. For example, boat tailed charges or more cylindrically shaped charges may utilize the techniques of the invention as may other variations of charge shape.

FIG. 3 illustrates the changed initiation strategy of the invention for attack of non-tank targets. It is known in advance of impact, either from before launch or from a sensor input in the weapon or by data link input that the target is light armor or not armored. In this instance, the explosive charge is initiated at the front or cone base and at the rear end of the charge, nearly simultaneously, with the detonation waves advancing in both directions and eventually meeting, in an extremely high pressure encounter. It is important to note that the use of the term "cone" does not demand the use of a conical shaped charge surface or exclude trumpet shaped, hemispherical shaped or other variations in liner geometry, but is used only for convenience.

With the dual end initiation, two effects which are achieved vary significantly from the conventionally initiated mode of operation illustrated in FIG. 2, specifically: (1) the nature off the jet formed, and (2) formation of a sidespray pattern. First, considering the formation of a modified jet, the collapse of the liner 38 occurs over a shorter length because the slower portion of the explosive charge 22, that is, the annular part nearest the detonator 34, gets a head start in collapse toward the longitudinal axis 28 which may also be considered to be the jet axis. Also, the reverse direction detonation wave and reversed Taylor angle, that is, off-normal liner projection angle, may combine, depending on design specifics, to result in very high material collapse speed. The collapse speed, if supersonic in the metallic liner 38, results in a noncoherent jet formation which scatters the jet 40A to a significant degree. The result is that a shorter jet preceded by a very high velocity tip but being somewhat thicker, or less stretched, impacts the target, with a behavior that is somewhat akin to an explosively formed penetrator as regards scattering and hole size with more beyond-armor damage than an efficient jet would achieve.

However, penetration capability remains high enough that even tank armor would not adequately defend against it in top attack, while simultaneously, the kill potential is enhanced significantly from the jet itself against light armor or other material targets.

As clearly seen in FIG. 1, the warhead 22 includes a fragmentation case 26 proximate the outer peripheral surface 24 and intermediate the front and rear initiation surfaces 30, 32. The fragmentation layer may be of a conventional fracture grid construction and is responsive to both the first and second detonation waves to produce the radially directed sidespray pattern substantially focussed in a planar pattern transverse of the longitudinal axis 28.

Next, the sidespray is increased in velocity by the increased charge at the cone base (non-zero due to truncation), and at the same time is focused in a planer pattern nearly normal to the warhead axis, which cuts through light structure in the close proximity and achieves vulnerability hits even beyond the energy density kill distances in most cases. This enhancement of sidespray effectiveness is at no penalty to the shaped charge performance, recognizing that shaped charges are extremely sensitive to any nonuniformity in mass confinement and therefore do not normally lend themselves to efficient sidespray lethality and maximum penetration capability in the same design.

The concepts of the invention can be applied to submunitions, projectiles, bombs and warheads for rockets or missiles. The necessary ingredient is knowledge of the target to be attack. When this is known before launch, a prelaunch input to the fuzing may be used. In modern, brilliant munitions, this can be done autonomously within the weapon design.

While a preferred embodiment of the invention has been disclosed in detail, 15 should be understood by those skilled in the art that various other modifications may be made to the illustrated embodiments without departing from the scope of the invention as described in the specification and defined in the appended claims.

I claim:

1. A dual operating mode warhead comprising:

an axially symmetric explosive charge having a longitudinal axis and an outer peripheral surface extending between a front facing initiation surface and a rear facing initiation surface, said front facing initiation surface and said rear facing initiation surface both lying in planes transverse of said outer peripheral surface;

first detonating means for initiating detonation of said explosive charge at said front facing initiation surface and creating a first detonation wave for travelling through said explosive charge toward said rear facing initiation surface; and second detonating means for initiating detonation of said explosive charge at said rear facing initiation surface and creating a second detonation wave for travelling through said explosive charge toward said forward facing initiation surface;

shaped lined charge means shaped for penetration of armor or hard target material proximate said front facing initiation surface and responsive to the second detonation wave to produce a high speed forward traveling jet with armor piercing capability; and a fragmentation case having a fracture grid construction proximate said outer peripheral surface and intermediate said front facing initiation surface and Said rear facing initiation surface;

whereby actuation of said second detonating means alone results in maximum armor penetration of a target; and whereby substantially simultaneous actuation of said first and second detonating means results both in armor penetration of the target and in a radially directed sidespray pattern of fragmentation of said fragmentation case against the target.

2. A dual operating mode warhead as set forth in claim 1 wherein said front facing initiation surface includes a lined cavity symmetric about the longitudinal axis and an annular surface at a base of said cavity; and wherein said shaped lined charge means includes liner means fixedly disposed in a contiguous relationship with said front facing initiation surface, said liner means being responsive to said second detonation wave for collapsing toward said longitudinal axis and generating a combined long narrow high speed penetrating jet for armor penetration.

3. A method of selectively operating a warhead according to the type of intended target comprising the steps of:

providing an axially symmetric explosive charge having a longitudinal axis and an outer peripheral surface extending between a front facing initiation surface and a rear facing initiation surface, the front facing initiation surface and the rear facing initiation surface both lying in planes transverse of the outer peripheral surface, the explosive charge including a shaped lined charge means shaped for penetration of armor proximate the front facing initiating surface and responsive to the second detonation wave to produce a high speed forward travelling jet with armor piercing capability;

providing a fragmentation case proximate the outer peripheral surface of the explosive charge intermediate the front facing initiation surface and the rear facing initiation surface;

operating a first detonating means for initiating detonation of the explosive charge at the front facing initiation surface and creating a first detonation wave for travelling through the explosive charge toward the rear facing initiation surface; and operating a second detonating means for initiating detonation of the explosive charge at the rear facing initiation surface and creating a second detonation wave for travelling through the explosive charge toward the forward facing initiation surface;

whereby actuation of the second detonating means alone results in maximum armor penetration of a target; and whereby substantially simultaneous actuation of the first and second detonating means results both in armor penetration of the target and in a radially directed sidespray pattern of fragmentation of the fragmentation case against the target.

* * * * *